US006411790B1

(12) United States Patent
Kim et al.

(10) Patent No.: US 6,411,790 B1
(45) Date of Patent: Jun. 25, 2002

(54) APPARATUS FOR FEEDING DEVELOPING SOLUTION FOR A WET TYPE ELECTROPHOTOGRAPHIC COLOR PRINTER

(75) Inventors: Jong-woo Kim; Chung-guk Baek; Un-ho Baik, all of Suwon (KR)

(73) Assignee: SamSung Electronics Co., Ltd., Suwon (KR)

( * ) Notice: Subject to any disclaimer, the term of this patent is extended or adjusted under 35 U.S.C. 154(b) by 0 days.

(21) Appl. No.: 09/639,342

(22) Filed: Aug. 16, 2000

(30) Foreign Application Priority Data

Aug. 16, 1999 (KR) ..... 99-33735

(51) Int. Cl.[7] ..... G03G 15/10

(52) U.S. Cl. ..... 399/237; 399/233; 399/238

(58) Field of Search ..... 399/233, 237, 399/238, 247, 249, 250, 251, 359, 224, 259, 57; 347/89

(56) References Cited

U.S. PATENT DOCUMENTS 4,476,472 A * 10/1984 Aiba et al.
4,796,051 A * 1/1989 Monkelbaan et al. ... 399/237 X
5,950,054 A * 9/1999 Kim ..... 399/237
5,970,289 A * 10/1999 Yoo ..... 399/237
6,011,943 A * 1/2000 Kim ..... 399/238
6,101,356 A * 8/2000 Kim et al. ..... 399/237 X
6,151,469 A * 11/2000 Lee ..... 399/237

* cited by examiner

*Primary Examiner*—Susan S. Y. Lee
(74) *Attorney, Agent, or Firm*—Robert E. Bushnell, Esq.

(57) ABSTRACT

A developing solution feeder of a wet type electrophotographic color printer includes a plurality of circulation tanks for storing the developing solution to be fed to a developing unit; a plurality of injection nozzles for jetting the developing solution stored in the circulation tanks to a developing gap of the developing unit; a plurality of ink storage tanks and a carrier storage tank for respectively storing the condensed ink of a certain color and a carrier to be fed to the circulation tanks, respectively; a waste tank for collecting the waste developing solution produced from the circulation tanks; a refill cartridge for the supplementation of the condensed ink or the carrier; developing solution refilling/waste developing solution collecting means for refilling the ink storage tanks or the carrier storage tank with the condensed ink or the carrier, respectively, and for evacuating the waste developing solution collected in the waste tank to the empty refill cartridge; and ink injecting/constant feeding means having a gear pump for jetting the condensed ink or the refill cartridge to the ink storage tanks during the condensed ink refilling process by the pumping action while being driven in a certain direction, and for feeding the appropriate amount of the condensed ink stored in the ink storage tanks to the circulation tanks while being driven in a reverse direction. Accordingly, since the condensed ink within the refill cartridge is jetted to the ink storage tanks by the gear pump, the condensed ink is stored in the refill cartridge, purely. As a result, the property change of the condensed ink, which is caused due to the presence of compressed air, is prevented. Further, since the gear pump functions to feed the condensed ink of the ink storage tanks to the circulation tanks, the condensed ink is fed to the circulation tanks in more appropriate amounts.

19 Claims, 3 Drawing Sheets

APPARATUS FOR FEEDING DEVELOPING SOLUTION FOR A WET TYPE ELECTROPHOTOGRAPHIC COLOR PRINTER

This application makes reference to, incorporates the same herein, and claims all benefits accuring under 35 U.S.C. §119 from an application for APPARATUS FOR DELIVERING DEVELOPER OF A LIQUID ELECTROPHOTOGRAPHIC COLOR PRINTER earlier filed in the Korean Industrial Property Office on Aug. 16, 1999 and there duly assigned Serial No. 33735/1999.

BACKGROUND OF THE INVENTION

1. Field of the Invention

The present invention relates to a wet type electrophotographic color printer, and more particularly to an apparatus for feeding a developing solution of a certain concentration to a developing unit for developing an electrostatic latent image of a photosensitive medium.

Here, it may be noted that the term 'printer' is not limited to a general laser printer only, but includes all kinds of printing apparatuses for printing images by using the electrophotographic method, such as a copier, facsimile machine, etc.

2. Description of the Prior Art

Generally, a wet type electrophotographic color printer prints a desired image by forming an electrostatic latent image by the processes of radiating a laser beam to a photosensitive medium such as a photosensitive belt, then developing the electrostatic latent image formed on the photosensitive medium with a developing solution having a solid toner of a certain color and a liquid carrier as a solvent, and finally transferring the developed form to a printing paper.

Such a wet type electrophotographic color printer may be divided into an engine section and a video controller. Here, the video controller functions to decode data transmitted from a data outputting device such as a computer, or the like, and converts the decoded data into printable form, stores the converted data, and outputs the stored data in the form of serial data for printing after communicating with the engine section.

The engine section includes a photosensitive medium, a charged unit for electrifying the surface of the photosensitive medium at a certain electric potential, an exposure unit for forming the electrostatic latent image on the photosensitive medium by radiating a beam converted in accordance with the electrical data of the to-be-printed portions to the photosensitive medium, a developing unit for developing the latent image of the photosensitive medium by feeding developing solution to the photosensitive medium, a transferring unit for transferring the image of the photosensitive medium to the printing paper, and a developing solution feeder for feeding the developing solution of a certain concentration to the developing unit.

The main part of the wet type electrophotographic color printer constructed as above will be described in detail below. As will be described, in a conventional electrophotographic color printer, condensed ink is discharged from a refill cartridge by compressed air through ink feeding valves to ink storage tanks and carrier is fed to a carrier storage tank. Circulation tanks containing the condensed ink and carrier are maintained at an appropriate concentration by admitting ink from the respective ink storage tanks through ink feeding valves, or carrier from the carrier storage tank, through a carrier feeding valve.

In the developing solution feeder of the conventional wet type electrophotographic color printer, however, since the condensed ink or the carrier stored in the ink storage tanks and the carrier storage tank is fed to the circulation tanks through the ink feeding valves and the carrier feeding valve, the problem arises that the condensed ink or the carrier can not always be fed consistently to the developing solution, leading to an inconsistent concentration of the developing solution. This is because the feeding valves are poorly controllable due to the structure of the feeding valves. Further, the ink feeding valves may have sludge formed in them which results in a narrowed channel for the condensed ink. Accordingly, the image density deteriorates due to the inconsistent concentration of the developing solution which is caused due to the inconstant supply of the condensed ink.

Further, the conventional developing solution feeder employs a refill cartridge using compressed air. This means that the condensed ink or the carrier is jointly stored with the compressed gas in the refill cartridge, which again results in deteriorated image quality and the developing solution may change in concentration due to the condensed ink's or the carrier's property change by the compressed air.

Further, since the condensed ink or the carrier is jointly stored with the compressed air in the refill cartridge of the conventional developing solution feeder, the waste developing solution cannot be efficiently collected therein due to the presence of the compressed air.

SUMMARY OF THE INVENTION

It is therefore an object of the present invention to provide an improved wet-type electrophotographic color printer.

A further object of the invention is to provide an improved developing solution-feeding apparatus for a wet-type electrophotographic printer.

A yet further object is to provide a developing solution-feeding apparatus which leads to better image quality.

A still further object is to provide a developing solution-feeding apparatus which allows better control of the developing solution concentration.

Another object is to provide a developing solution-feeding apparatus which avoids sludge formation in the ink feeding valves.

Yet another object is to provide a developing solution-feeding apparatus which is simpler.

Still another object is to provide a developing solution-feeding apparatus which does not employ compressed air.

The present invention has been devised to overcome the above problems by providing a developing solution feeder for a wet type electrophotographic color printer capable of appropriately feeding condensed ink or carrier for maintaining a consistent concentration of the developing solution in circulation tanks, while avoiding the possibility of using ink feeding valves and carrier feeding valves.

The present invention also provides a developing solution feeder for a wet type electrophotographic color printer capable of preventing property change of the condensed ink or the carrier basically, which is caused due to compressed air, by using a refill cartridge filled with condensed ink or carrier, purely.

The present invention also provides a developing solution feeder for a wet type electrophotographic color printer capable of feeding the condensed ink or the carrier stored in the refill cartridge to the ink storage tank or the carrier storage tank with one pump, and feeding the condensed ink or the carrier stored in the ink storage tank and the carrier storage tank to the circulation tanks to maintain a consistent concentration of the condensed ink or the carrier.

The present invention provides a color printer having the developing solution feeder which has an improvement as above and achieves the above objects by a developing solution feeding apparatus of a wet type electrophotographic color printer, including: a plurality of circulation tanks for storing developing solution to be fed to a developing unit of the printer, respectively; plurality of injection nozzles for jetting the developing solution stored in the respective circulation tanks to a developing gap of the developing unit, respectively; a plurality of ink storage tanks for storing a condensed ink of a certain color to be fed to the respective circulation tanks; a carrier storage tank for storing a carrier to be fed to the respective circulation tanks; a waste tank for collecting a waste developing solution produced from the respective circulation tanks; a refill cartridge for storing the condensed ink of a certain color or the carrier to supplement the condensed ink or the carrier of the ink storage tanks or the carrier storage tank; developing solution refilling/waste developing solution collecting means for refilling the condensed ink or the carrier of the refill cartridge to the ink storage tanks or the carrier storage tank, and for collecting the waste developing solution in the waste tank to the empty refill cartridge; and ink injecting/constant feeding means for jetting the condensed ink of the refill cartridge to the ink storage tanks during the condensed ink refilling process by the developing solution refilling/waste developing solution collecting means, and for feeding the required amount of the condensed ink stored in the ink storage tanks to the circulation tanks.

Here, the circulation tanks have concentration detecting means for detecting the concentration of the developing liquid stored therein. Further, the ink storage tanks have ink agitators therein which are driven by a single driving source, respectively.

The developing solution refilling/waste developing solution collecting means includes: a common mounting section for mounting the refill cartridge thereon; and a valve unit disposed under the common mounting section to be moved in a vertical and a horizontal direction, and having a plurality of valves to be fitted to an outlet of the refill cartridge. The valve units include four ink feeding valves, a carrier feeding valve, and a waste developing solution valve. The four ink feeding valves are connected to the respective ink storage tanks, the carrier feeding valve is connected to the carrier storage tank; and a waste developing solution valve is connected to the waste tank.

The ink injecting/constant feeding means includes a first ink feeding pipe for connecting a plurality of ink feeding valves formed on the valve unit with the respective ink storage tanks; a second ink feeding pipe branched from the first ink feeding pipe, and connected to the circulation tanks, respectively; a gear pump disposed on the first ink feeding pipe, for jetting the condensed ink of the refill cartridge to the ink storage tanks by a pumping action while being driven in a certain direction, and for feeding the condensed ink of the ink storage tanks to the circulation tanks by the pumping action while being driven in a reverse direction; and back flow preventing means disposed on the first and second ink feeding pipes, and for selectively opening/closing the first and second ink feeding pipes, to thereby prevent a back flow of the ink while the ink is pumped by the gear pump.

According to an embodiment of the present invention, since the condensed ink stored in the refill cartridge is jetted to the ink storage tank by the pumping action of a gear pump, the condensed ink is stored in a refill cartridge, purely, without the presence of compressed air. Accordingly, the property change of the ink due to compressed air, is prevented.

Further, since the condensed ink stored in the ink storage tank is fed to the circulation tanks by a gear pump, the required amount of ink is more precisely fed to the circulation tanks than a conventional structure which employs the constant feeding ink valve .Accordingly, the concentration of the developing solution is precisely and conveniently compensated, and further, the printing quality is improved.

According to another preferred embodiment of the present invention, the developing solution feeding apparatus of a wet type electrophotographic color printer further includes carrier injecting/constant feeding means for jetting the carrier of the refill cartridge to the carrier storage tank during the carrier refilling process by the developing solution refilling/waste developing solution collecting means, and for feeding the required amount of the carrier stored in the carrier storage tank to the circulation tanks.

The carrier injecting/constant feeding means includes a first carrier feeding pipe for connecting the carrier feeding valve of the valve unit with the carrier storage tank; a second carrier feeding pipe branched from the first carrier feeding pipe and connected to the respective circulation tanks; a gear pump disposed on the first carrier feeding pipe, for jetting the carrier of the refill cartridge to the carrier storage tank by the pumping action while being driven in a certain direction, and for jetting the carrier of the carrier storage tank to the circulation tanks by the pumping action while being driven in a reverse direction; back flow preventing means disposed on the first and second carrier feeding pipes, and for selectively opening/closing the first and second carrier feeding pipes, to thereby prevent a back flow of the carrier while the carrier is pumped by a gear pump; and a plurality of opening/closing valves disposed on the circulation tank connecting portions of the second carrier feeding pipe, and for selectively opening/closing the circulation tank connecting portions.

The carrier is stored in the refill cartridge, purely, without the compressed air, and further, the required amount of carrier in the carrier storage tank is fed to the circulation tanks precisely. Accordingly, the property change of the carrier, which is caused due to compressed air in the refill cartridge, is prevented, and the concentration of the developing solution is precisely and conveniently compensated. As a result, the printing quality is improved.

Further, according to another embodiment of the present invention, since the constant feeding ink valve and the constant feeding carrier valve, which are relatively expensive, can be omitted, the manufacturing cost is reduced.

Another above object will be accomplished by a wet type electrophotographic color printer having a photosensitive medium; a charged unit for electrifying the surface of the photosensitive medium at a certain electric potential; an exposure unit for forming the electrostatic latent image on the photosensitive medium by jetting a beam converted in accordance with the electrical data of the to-be-printed portions to the photosensitive medium; a developing unit for developing the latent image of the photosensitive medium by feeding developing solution to the photosensitive medium; a transferring unit for transferring the image of the photosensitive medium to the printing paper; and a developing solution feeder for appropriately feeding the developing solution of a certain concentration to the developing unit.

The developing solution feeder includes a plurality of circulation tanks for storing the developing solution to be fed to the developing unit, and having a concentration detecting device for detecting the concentration of the developing solution stored therein; a plurality of injection nozzles for jetting the developing solution stored in the respective circulation tanks to a developing gap of the developing unit; a plurality of ink storage tanks for storing condensed ink of a certain color to be fed to the respective circulation tanks, and having ink agitators disposed therein to be driven by a single driving source; a carrier storage tank for storing carrier to be fed to the respective circulation tanks; a waste tank for collecting waste developing solution produced from the respective circulation tanks; a refill cartridge for storing the condensed ink of a certain color or the carrier for supplementation of the condensed ink or the carrier to the ink storage tanks or the carrier storage tank; developing solution refilling/waste developing solution collecting means having a common mounting section for mounting the refill cartridge thereon, and a valve unit which is disposed under the common mounting section to be moved in vertical and horizontal directions and is provided with a plurality of valves to be fitted to the outlet of the refill cartridge, for refilling the ink storage tanks or the carrier storage tank with the condensed ink or the carrier of the refill cartridge, and also for collecting the waste developing solution collected in the waste tank to the empty refill cartridge; ink injecting/constant feeding means for jetting the condensed ink of the refill cartridge to the ink storage tanks during the condensed ink refilling process by the developing solution refilling/waste developing solution collecting means, and also for feeding the required amount of the condensed ink stored in the ink storage tanks to the circulation tanks; and carrier injecting/constant feeding means for jetting the carrier of the refill cartridge to the carrier storage tank during the carrier refilling process by the developing solution refilling/the waste developing solution collecting means, and for feeding the required amount of the carrier stored in the carrier storage tank to the circulation tanks.

Accordingly, there is no need to use compressed air in the refill cartridge, and the condensed ink or the carrier stored in the ink storage tank and the carrier storage tank is fed to the circulation tank for consistent concentration of the condensed ink or the carrier in the circulation tank. As a result, the property change of the condensed ink and the carrier, which is caused due to compressed air, is essentially prevented, and the concentration of the developing solution is more precisely maintained.

Additional objects and advantages of the invention will be set forth in part in the description which follows and will be obvious from the description, or may be learned by the practice of the invention.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE DRAWINGS

Figure 1:
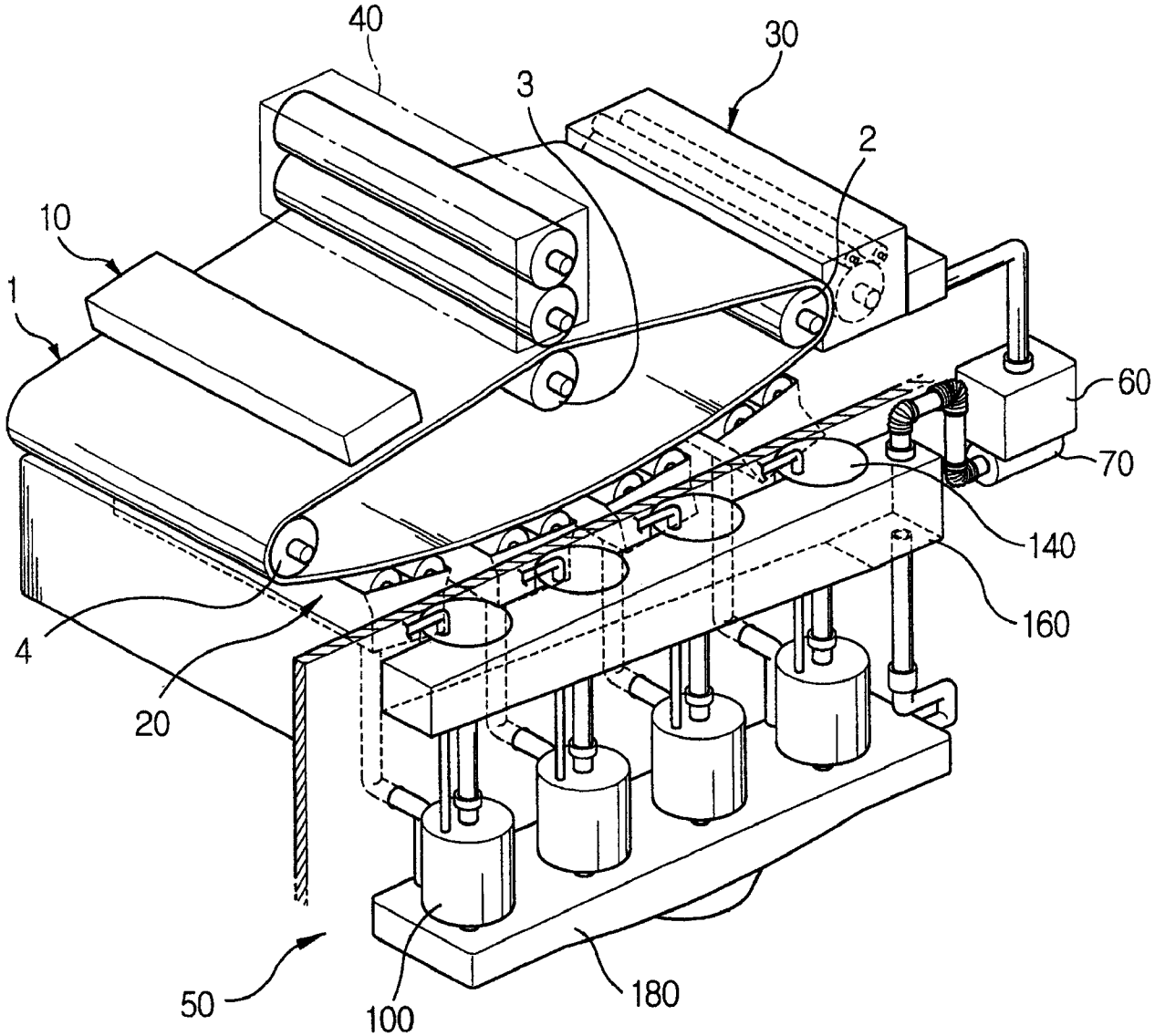
FIG. 1 (Prior Art)
FIG. 1 is a schematic rear perspective view showing the main portion of a conventional wet type electrophotographic color printer.

Turning now to the drawings, the main parts of a conventional wet type electrophotographic color printer constructed as described above are schematically shown in FIG. 1, which will be described below. In FIG. 1, reference numeral 1 refers to a photosensitive belt acting as the photosensitive medium. As shown in FIG. 1, the photosensitive belt 1 is reeled to travel on rollers 2, 3, and 4 which are disposed within a printer body (not shown).

Around the photosensitive belt 1, a charged unit 10, an exposure unit (not shown), a developing unit 20, a drying unit 30, and a transferring unit 40, etc. are disposed. Further, near the developing unit 20, a developing solution feeder 50 is disposed to feed the developing solution of a certain concentration to the developing unit 20. Here, the developing solution is the mixture of a condensed ink comprised of a powder toner and a liquid carrier, which is diffused to have a certain concentration approximately of 2–4 wt %. And hereinafter, the "concentration of developing solution" equals the concentration (wt %) of the toner of the developing solution. Further, the toner has pigments of yellow, magenta, cyan, and black.

Figure 2:
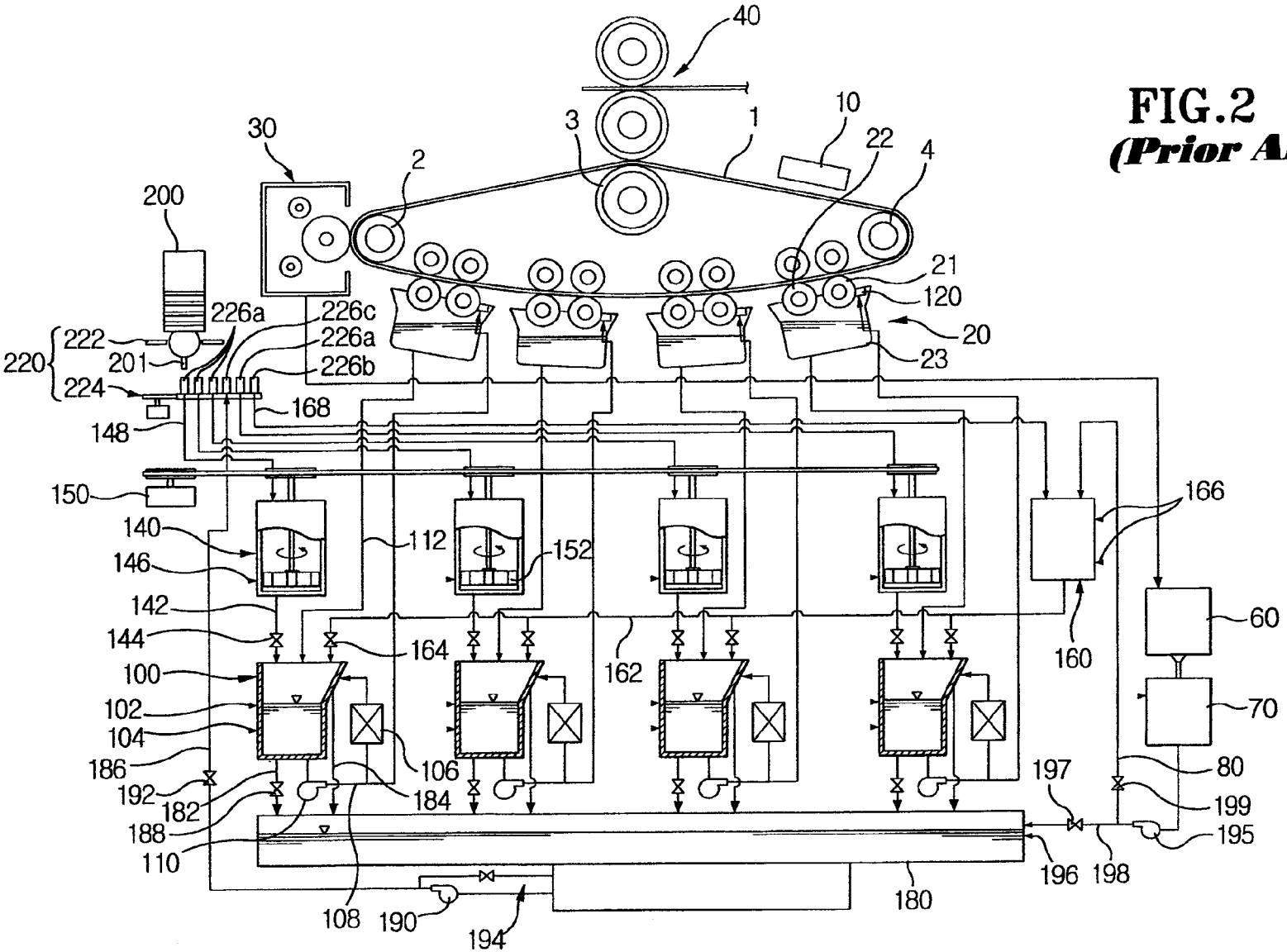
FIG.2 (Prior Art)
FIG. 2 is a view for schematically showing the structure of a developing solution feeder of a conventional wet type electrophotographic color printer.

As shown in FIG. 2, the developing solution feeder 50 includes a plurality of circulation tanks 100 for storing the developing solution to be led to the developing unit 20, a plurality of injection nozzles 120 for jetting the developing solution within the circulation tanks 100 to a developing gap of the developing unit 20, a plurality of ink storage tanks 140 for storing condensed ink of the respective colors to be fed to the circulation tanks 100, a carrier storage tank 160 for storing a carrier to be fed to the circulation tanks 100, a waste tank 180 for collecting waste developing solution produced from the circulation tanks 100, a refill cartridge 200 for storing the condensed ink or the carrier together with compressed air for supplementation of the condensed ink or the carrier to the ink storage tanks 140 or the carrier storage tank 160, developing solution refilling/waste developing solution collecting means 220 for refilling the condensed ink or the carrier of the refill cartridge 200 to the ink storage tanks 140 or the carrier storage tank 160, and for collecting the waste developing solution stored in the waste tank 180 to the empty refill cartridge.

Upper and lower limit sensors 102 and 104 are disposed in the circulation tanks 100 to detect a liquid level of the developing solution stored in the circulation tanks 100, and concentration detecting devices 106 are disposed near the circulation tanks 100 to detect the concentration of the developing solution stored in the circulation tanks 100, respectively.

The respective circulation tanks 100 and the injection nozzles 120 of the developing unit 20 are connected through developing solution feeding pipes 108. Further, developing solution pumps 110 are connected to the developing solution feeding pipes 108, respectively, to feed the developing solution within the circulation tanks 100 by a pumping action. Accordingly, the developing solution within the circulation tanks 100 is jetted to developing rollers of the developing unit 20 through the injection nozzles 120, to perform the developing process. After the developing process, the residual developing solution is stored in developing unit casings 23, together with the developing solution which is squeezed by squeeze rollers 22. The developing unit casings 23 are connected to the circulation tanks 100 through the developing solution feeding pipes 112, respectively. Accordingly, the developing solution stored in the developing unit casings 23 can be collected in the circulation tanks 100.

The plurality of ink storage tanks 140 are connected to the corresponding circulation tanks 100 through second ink feeding pipes 142, while the carrier storage tank 160 is connected to the circulation tanks 100, respectively, through second carrier feeding pipe 162. Accordingly, the condensed ink, or the carrier can be fed to the respective circulation tanks 100. On the second ink and carrier feeding pipes 142 and 162, constant feeding ink valves 144 and a constant feeding carrier valve 164 are disposed, respectively, for feeding an appropriate amount of the condensed ink or the carrier to the circulation tanks 100, respectively. Accordingly, the developing solution within the circulation tanks 100 may always have a certain concentration.

Further, in the ink storage tanks 140 and the carrier storage tank 160, liquid level sensors 146 and 166 are disposed to sense the liquid level of the condensed ink and the carrier stored therein, respectively. Agitators 152, which are driven by a single driving source 150, are disposed in the ink storage tanks 140. Also, the ink storage tanks 140 and the carrier storage tank 160 are connected to the developing solution refilling/waste developing solution collecting means 220 through the first ink feeding pipes 148 and the first carrier feeding pipe 168, respectively, which will be described later.

The waste tank 180 collects the waste developing solution produced from the circulation tanks 100, and is connected to the respective circulation tanks 100 through waste developing solution collecting pipes 182 and overflow pipes 184, while connected to the developing solution refilling/waste developing solution collecting means 220 through a waste developing solution collecting pipe 186, respectively. Here, the waste developing solution collecting pipes 182 and the overflow pipes 184 are the channels through which the waste developing solution and the overflow of the developing solution in the circulation tanks 100 are fed, and the waste developing solution collecting pipe 186 is the channel through which the waste developing solution in the waste tank 180 is collected to the empty refill cartridge. Valves 188 are disposed on the waste developing solution collecting pipes 182 to selectively open/close the waste developing solution collecting pipes 182, while another valve 192 is disposed on the waste developing solution collecting pipe 186 to selectively open/close a waste pump 190 for pumping the waste developing solution in the waste tank 180 and the waste developing solution collecting pipes 186.

Further, the waste tank 180 has a liquid level sensor 194 disposed therein for sensing the liquid level of the waste developing solution stored in the waste tank 180, and an agitator 196 disposed therein for agitating the waste developing solution. Also, one side of the waste tank 180 is connected with a carrier collecting pipe 198 for collecting moisture which is condensed by a condenser 60 of the drying unit 30 and conducting the moisture to the waste tank 180. Below the condenser 60, a purge tank 70 is disposed to collect the carrier and water, which are condensed forms of the gaseous carrier vaporized by the drying unit 30 and the moisture trailed in the air which is inevitably drawn from the outside, respectively. Further, a pump 195 and an opening/closing valve 197 are disposed on the carrier collecting pipe 198, respectively. Also, a branch pipe 80 is connected with the carrier collecting pipe 198 to feed the collected carrier to the carrier storage tank 160. A valve 199 is disposed on the branch pipe 80.

The refill cartridges 200 of the same size respectively store four colors of the condensed ink or the carrier. The refill cartridges 200 store the compressed air together with the ink or carrier. Accordingly, by pressing outlets 201 of the refill cartridges 200, the condensed ink or the carrier in the refill cartridges 200 is rapidly drawn out of the refill cartridges 200 through the outlets 201 thereof.

The developing solution refilling/waste developing solution collecting means 220 includes a common mounting section 222 on which the refill cartridge 200 is mounted, and a valve unit 224 which is disposed under the mounting section 222 to be moved in a vertical and a lateral direction. The valve unit 224 includes a plurality of valves corresponding to the outlet 201 of the refill cartridge 200 which is mounted on the common mounting section 222. The valves are comprised of four ink feeding valves 226*a*, one carrier feeding valve 226*b*, and one waste developing solution valve 226*c*. The four ink feeding valves 226*a* are connected to the respective ink storage tanks 140 through the first ink feeding pipes 148, and the carrier feeding valve 226*b* is connected to the carrier storage tank 160 through the first carrier feeding pipe 168. Further, the waste developing solution valve 226*c* is connected to the waste tank 180 through the waste developing solution collecting pipe 186.

The developing solution feeder of the conventional wet type electrophotographic color printer constructed as above functions to feed the developing solution of a certain concentration stored in the circulation tanks 100 to the developing unit 20 upon receipt of the printing command, by the processes described as follows:

As the printing starts, the developing solution pumps 110 disposed on the developing solution feeding pipes 108 of the circulation tanks 100 operate to pump the developing solution stored in the circulation tanks 100 to the injection nozzles of the developing unit 20. Then the injection nozzles 120 jet the developing solution pumped as above to the developing gap of the developing unit 20, thereby developing the electrostatic latent image of the photosensitive belt 1. Here, after the developing process, the residual developing solution and the developing solution squeezed by the squeeze rollers 22 are stored in the developing unit casings 23, to be fed to the respective circulation tanks 100 through the developing solution collecting pipes 112.

In such a situation, since the amount of the developing solution stored in the circulation tanks 100 decreases as the developing solution is used for developing the electrostatic latent image of the photosensitive belt 1, the condensed ink and the carrier should be constantly fed to the respective circulation tanks 100 to maintain a certain concentration of the developing solution. Further, in accordance with the printed image, the amount of necessary condensed ink and carrier varies. More specifically, if a simple image or small image is to be printed, the carrier is used more than the condensed ink, while more condensed ink is used than the carrier when printing complicated images. Accordingly, in accordance with the amount of the condensed ink and the carrier used, the condensed ink and the carrier should be fed appropriately to maintain a certain concentration of the developing solution. According to the experiments, the concentration of the image is not affected when the concentration of the developing solution is kept under 2.5 wt %. When the concentration of the developing solution is under 2 wt %, the concentration of the image deteriorates. Further, the print quality is proven to be acceptable when the concentration of the developing solution is kept between 2.5–3.5 wt %. Accordingly, the concentration of the developing solution has to be kept between 2.5–3.5 wt %.

To maintain the correct concentration of the developing solution, the concentration detecting devices 106 disposed in the respective circulation tanks 100 detect the concentration of the developing solution while the developing solution within the circulation tanks 100 continuously circulates. The detected results are outputted to a system controller which is not shown. If the concentration of the developing solution is determined to be out of the reference range, i.e., out of 2.5–3.5 wt %, the constant feeding ink valves 144 and the constant feeding carrier valve 164 are opened to permit the condensed ink and/or carrier to be fed to the corresponding circulation tanks 100, respectively.

In other words, when the concentration of the developing solution is low, the constant feeding ink valves 144 are opened to permit the condensed ink to be fed, while when the concentration of the developing solution is high, the constant feeding carrier valve 164 is opened to permit the carrier to be fed. Accordingly, the concentration level of the developing solution stored in the circulation tanks 100 is correctly maintained.

By the above-described processes, the printing is performed in a manner that the developing solution of a certain concentration in the circulation tanks 100 is constantly fed to the developing unit 20. During the printing process, the level sensors 146 and 166 disposed in the ink storage tanks 140 and the carrier storage tank 160 detect the liquid level of the condensed ink or the carrier stored in the respective tanks 140 and 160.

Here, if the detected results indicate 'low level or empty', the system controller generates a message for supplementation of the condensed ink or the carrier to the corresponding tanks. Here, the tanks in need of supplementation may be an ink storage tank 140 or the carrier storage tank 160. If the tanks in need of supplementation are the ink storage tanks 140, the color of the ink, i.e., yellow, magenta, cyan, and black, is indicated for selecting.

In accordance with the message from the system controller, the corresponding refill cartridge 200 is mounted on the common mounting section 222 of the developing solution refilling/waste developing solution collecting means 220. Then, the valve unit 224 is moved, to position the ink feeding valve 226*a* under the outlet 201 of the refill cartridge 200. Simultaneously, the valve unit 224 is raised to fit the outlet 201 of the refill cartridge 200 with the corresponding ink feeding valve 226*a* of the valve unit 224. Then, the contents of the refill cartridge 200 are discharged through the ink feeding valve 226*a* by the pressure of the compressed air and are rapidly fed to the tanks in need of supplementation. By the above-described process, the condensed ink or the carrier is supplemented to the ink storage tanks 140 or the carrier storage tank 160, whichever is in need of supplementation.

Meanwhile, when the amount of the waste developing solution in the waste tank 180 increases to the extent that it needs emptying, a new empty refill cartridge can be mounted on the common mounting section 222, or the waste developing solution can be emptied to the refill cartridge 200 fixed on the common mounting section 222, which is emptied out during the supplementing process. The latter case is described below in greater detail.

First, the valve unit 224 raised with respect to the common mounting section 222 is lowered to align the waste developing solution valve 226*c* of the valve unit 224 with the outlet 201 of the refill cartridge 200. Next, the valve unit 224 is raised as in the developing solution refilling process, to fit the outlet 201 with the waste developing solution valve 226*c*. Then, the waste pump 190 disposed on the waste developing solution collecting pipe 186 operates, to feed the waste developing solution stored in the waste tank 180 to the empty refill cartridge 200 by the pumping action.

Figure 3:
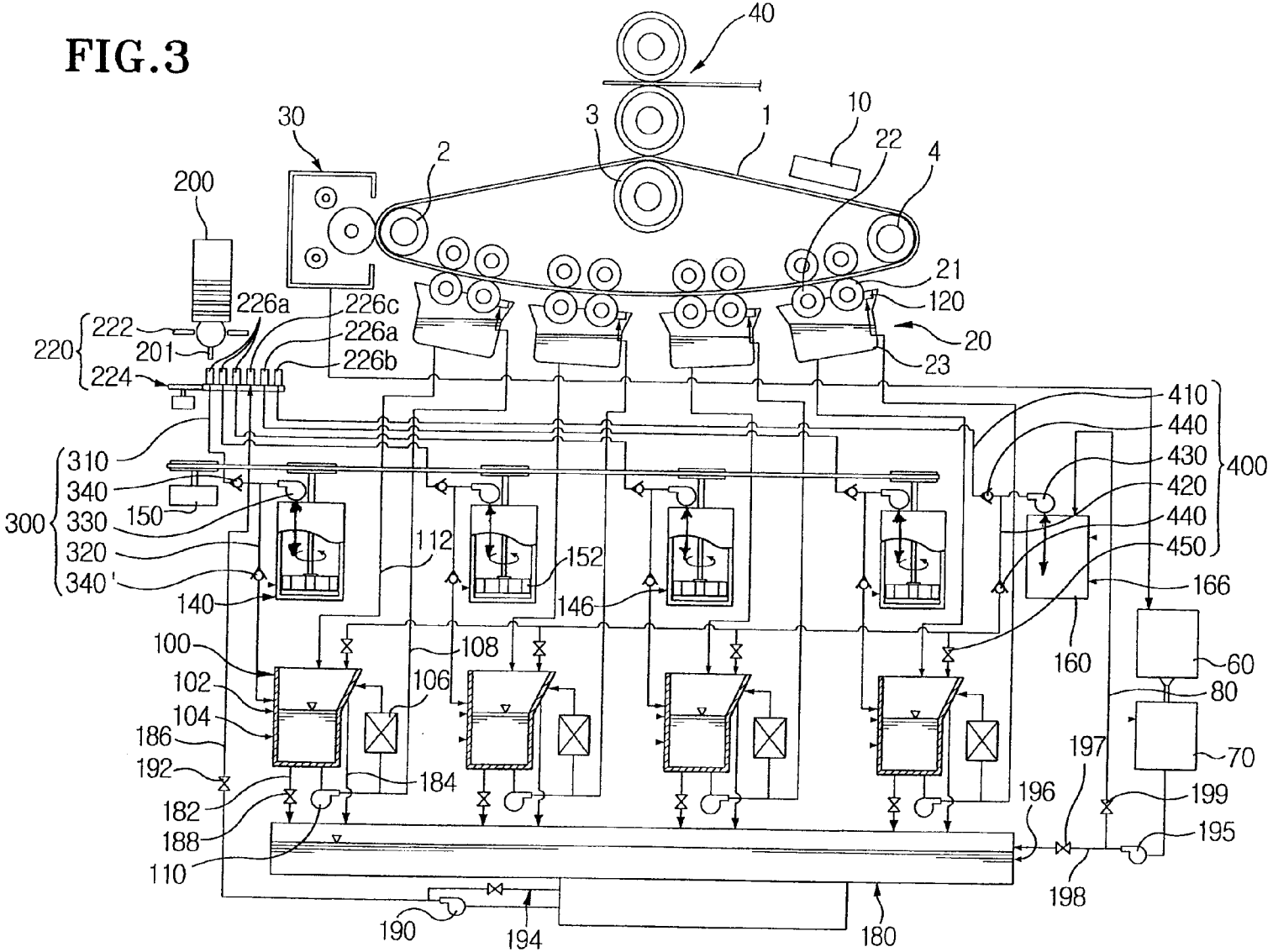
FIG. 3 is a view for schematically showing the structure of a developing solution feeder of a wet type electrophotographic color printer according to an embodiment of the present invention.

The present invention will now be described with reference to the accompanying drawings, wherein like reference numerals refer to the like elements throughout. FIG.3 schematically shows the structure of a developing solution feeder of a wet type electrophotographic color printer according to an embodiment of the present invention.

In FIG.3, a reference numeral 1 refers to a photosensitive belt, 10 is an electrifying unit, 20 is a developing unit, 30 is a drying unit, 40 is a transferring unit, and 50 is a developing solution feeder. Further, the reference numeral 100 refers to a circulation tank, 120 is an injection nozzle, 140 is an ink storage tank, 160 is a carrier storage tank, 180 is a waste tank, 200 is a refill cartridge, 220 is developing solution refilling/waste developing solution collecting means. The reference numeral 300 is ink injecting/constant feeding means, and 400 is carrier injecting/constant feeding means.

The circulation tanks 100 store the developing solution, which is to be fed to the developing unit 20, and feed the developing solution stored therein to the injection nozzles 120 of the developing unit 20 through developing solution feeding, pipes 108. The developing solution pumps 110 are disposed on the developing solution feeding pipes 108. Further, near the circulation tanks 100, concentration detecting devices 106 are disposed to detect the concentration of the developing solution stored in the circulation tanks 100.

The injection nozzles 120 function to jet the developing solution which is fed by the developing solution pumps 110 to the developing gap of the developing unit 20. After the developing process, the residual amount of the developing solution and the developing solution squeezed by the squeeze rollers 22 is stored in a developing unit casing 23, and is collected in the circulation tanks 100 through the developing solution collecting pipes 112.

The ink storage tanks 140 store the condensed ink to be fed to the circulation tanks 100, while the carrier storage tank 160 stores the carrier which is also to be fed to the circulation tanks 100. Inside the ink storage tanks 140, ink agitators 152 are disposed to be driven by a single driving source 150. Further, inside the ink storage tanks 140 and the carrier storage tank 160, level sensors 146 and 166 are disposed to detect the liquid level of the condensed ink or the carrier stored therein. When the level sensors 146 and 166 detect the low level signal, then the condensed ink or the carrier is fed.

The waste tank 180 is connected to the circulation tanks 100 through the waste developing solution collecting pipes 182 having, opening/closing valves 188 and overflow pipes 184, to collect and store the waste developing solution produced from the respective circulation tanks 100. Further, the waste tank 180 has a level sensor 196 for detecting the liquid level of the waste developing solution which is collected therein. Further, the waste tank 180 has an agitating device 194 for agitating the waste developing solution collected therein.

In order to supplement the condensed ink or the carrier to the respective ink storage tanks 140 or the carrier storage tank 160, the refill cartridge 200 stores the condensed ink of a certain color or the carrier. Unlike the conventional case, the refill cartridge 200 according to the present invention stores the condensed ink or the carrier, purely. Accordingly, the property change of the condensed ink or the carrier, which is caused due to the compressed air which has been jointly stored in the refill cartridge 200, is prevented. The method of refilling the refill cartridge with the condensed ink or the carrier will be described later.

The developing solution refilling/waste developing solution collecting means 220 functions to refill the condensed ink or the carrier stored in the refill cartridge 200 to the ink storage tanks 140 or the carrier storage tank 160, and to collect the waste developing solution stored in the waste tank 180 in the empty refill cartridge.

Such developing solution refilling/waste developing solution collecting means 220 includes a common mounting section, 222 on which the refill cartridge 200 is mounted, and a valve unit 224 which is disposed under the common mounting section 222 to be moved in vertical and horizontal directions. The valve unit 224 includes a plurality of valves, more specifically, four ink feeding valves 226*a*, one carrier feeding valve 226*b*, and one waste developing solution valve 226*c*, to be fitted to an outlet 201 of the refill cartridge 200 mounted on the common mounting section 222. The four ink feeding valves 226*a* are connected to the respective ink storage tanks 140 through first ink feeding pipes 310, and the carrier feeding valve 226*b* is connected to the carrier storage tank 160 through a first carrier feeding pipe 410. Further, the waste developing solution valve 226*c* is connected to the waste tank 180 through the waste developing solution pipe 186. Accordingly, the condensed ink or the carrier stored in the refill cartridge 200 is supplementarily fed to the ink storage tanks 140 or the carrier storage tank 160, and further, the waste developing solution collected in the waste tank 180 is evacuated to the empty refill cartridge.

The ink injecting/constant feeding means 300 functions to jet the condensed ink of the refill cartridge 200 to the ink storage tanks 140 during the condensed ink refilling process performed by the developing solution refilling/waste developing solution collecting means 220, and to feed the condensed ink stored in the ink storage tanks 140 by the appropriate amount.

Such ink injecting/constant feeding means 300 includes the first ink feeding pipe 310, a second ink feeding pipe 320 branched from the first ink feeding pipe 310 to be connected to the Page 24 of 45 circulation tanks 100, a gear pump 330 disposed on the first ink feeding pipe 310 for jetting the condensed ink of the refill cartridge 200 to the ink storage tanks 140 by the pumping action while being driven in a certain direction, and also for feeding the condensed ink stored in the ink storage tanks 140 to the circulation tanks 100 by the pumping action while being driven in a reverse direction, and back flow preventing means for preventing a back flow of the ink during the pumping action of the gear pump 330, i.e., for preventing the back flow of the developing solution of the circulation tanks through the second ink feeding pipe 320 during the pumping action to feed the condensed ink of the refill cartridge 200 to the ink storage tanks 140, and also for preventing the back flow of the condensed ink through the first ink feeding pipe 310 during the pumping action of the gear pump 330 to feed the condensed ink in the ink storage tank 140 to the circulation tanks 100.

Here, the gear pump 330 is a type of pumping device bidirectionally driven to selectively perform the pumping action to feed the condensed ink of the refill cartridge 200 to the ink storage tanks 140, or to feed the condensed ink of the ink storage tanks 140 to the circulation tanks 100. Although the gear pump 330 is employed in this description, such is not limited thereto, but any kind of pump may be used if it has the same functions as above.

The back flow preventing means may be check valves 340 and 340', which permit uni-directional flow of the liquid. The check valves 340 and 340' are disposed on the first and second ink feeding pipes 310 and 320, respectively. The check valve 340, which is disposed on the first ink feeding pipe 310, uni-directionally permits the condensed ink from the ink feeding valves 226*a* to the ink storage tanks 140. Further, the check valve 340', which is disposed on the second ink feeding pipe 320, permits the uni-directional flow of the condensed ink from the ink storage tanks 140 to the circulation tanks 100. Accordingly, when refilling the condensed ink of the refill cartridge 200 to the ink storage tanks 140, there is no possibility that the developing solution in the circulation tanks 100 will flow back to the ink storage tanks 140 by the pumping force of the gear pump 330. Likewise, there is no possibility that the condensed ink of the ink storage tanks 140 will flow back through the first ink feeding pipe 310 when feeding the condensed ink of the ink storage tanks 140 to the circulation tanks 100. Here, although the check valves are employed in this description as the back flow preventing means, it is not limited thereto, but any proper type can be employed, such as an electronic valve for selectively opening/closing the first and second ink feeding pipes 310 and 320 by an electronic control, etc.

Accordingly, with the ink injecting/constant feeding means 300, which is the main feature of the present invention, the condensed ink stored in the refill cartridge 200 is fed to the ink storage tanks 140 without charging the refill cartridge 200 with compressed air. Further, the required amount of the condensed ink can be precisely fed without requiring the constant feeding ink valve, which has caused the problem in feeding the appropriate amount of the ink. The ink feeding valve 226*a*, ink feeding pipe 310, check valves 340 and 340', gear pump 330, ink storage tank 140, second ink feeding pipe 320 and circulation tank 100 can be considered to make up an ink feeding/circulation unit.

Meanwhile, the carrier injecting/constant feeding means 400 functions to jet the carrier of the refill cartridge 200 to the carrier storage tank 160 during the refilling process performed by the developing solution refilling/waste developing solution collecting means 220, and also to feed the appropriate amount of the carrier stored in the carrier storage tank 160 to the circulation tanks 100.

Such carrier injecting/constant feeding means 400 includes a first carrier feeding pipe 410 connecting the carrier feeding valve 226*b* of the valve unit 224 with the carrier storage tank 160, a second carrier feeding pipe 420 branched from the first carrier feeding pipe 410 connected to the respective circulation tanks 100, a gear pump 430 for jetting the carrier of the refill cartridge 200 to the carrier storage tank 160 by pumping action of the gear pump being driven in a forward direction, and also for feeding the carrier of the carrier storage tank 160 to the circulation tanks 100 by pumping action while being driven in a reverse direction, check valves 440 and 440' acting as back flow preventing means, disposed on the first and second carrier feeding pipes 410 and 420 to selectively open/close the first and second carrier feeding pipes 410 and 420 so as to prevent the back flow of the carrier while the carrier is pumped by the gear pump 430, and a plurality of opening/closing valves 450 disposed on the circulation tank connecting portion of the second carrier feeding pipe 420 to selectively open/close the connecting portion. Carrier feeding valve 226*b*, carrier storage tank 160, gear pump 430, and carrier feeding pipes 410 and 420 can be considered to make up a carrier feeding unit.

Here, since the operation of the above elements is the same as described earlier in the description of the ink injecting/constant feeding means 300, further description thereof will be omitted, except for the opening/closing valves 450. The opening/closing valves 450 substitute for the conventional constant feeding carrier valve, and in this description, since the gear pump 430 functions to feed the required amount of the carrier, the opening/closing valves 450 simply function to open/close the circulation tank connecting portion of the second carrier feeding pipe 420. Accordingly, there is no need to use the conventional constant feeding carrier valve, which has a complicated structure.

Hereinafter, the operation of the developing solution feeder of a wet type electrophotographic color printer according to the present invention constructed as above will be described. The basic operation of the developing solution feeder, i.e., the operation to feed the developing solution of a certain concentration stored in the circulation tanks 100 to the developing unit 20 by the printing command, is the same as the conventional case, which will be described in greater detail as follows:

When the printing starts, the developing solution pumps 110 on the developing solution feeding pipes 108 of the circulation tanks 100 operate to pump the developing solution stored in the circulation tanks 100 to the injection nozzles 120 of the developing unit 20. The injection nozzles 120 jet the developing solution to the developing gap of the developing unit 20, thereby developing the electrostatic latent image of the photosensitive belt 1. After the developing process, the residual developing solution and the developing solution squeezed by the squeeze rollers 22 is stored in the developing unit casings 23, to be fed to the respective circulation tanks 100 through the developing solution collecting pipes 112.

During the above process, the concentration detecting devices 106 disposed in the circulation tanks 100 detect the concentration of the developing solution stored in the circulation tanks 100, while the developing solution continuously circulates. The detected results are outputted to a system controller (not shown). When the detected results indicate that the concentration of the developing solution is out of the reference range, i.e., out of 2.5–3.5 wt %, the gear pumps 330 and 430 are driven (in the reverse direction according to this description) to permit the condensed ink and/or carrier to be fed to the corresponding circulation tanks 100.

More specifically, when the concentration of the developing solution is low, the gear pump 330 is driven to feed the condensed ink to the circulation tanks 100. When the concentration of the developing solution is high, then the gear pump 430 is driven to pump the carrier to the circulation tanks 100. In such a situation, by controlling the rotational frequency of the gear pumps 330 and 430, the required amount of condensed ink or the carrier can be fed to the circulation tanks 100. Here, the condensed ink, which is pumped from the ink storage tanks 140, does not flow through the first ink feeding pipe 310 due to the check valve 340, which is disposed on the first ink feeding pipe 310, but is fed to the circulation tanks 100 through the second ink feeding pipes 320 which are open. The carrier also does not flow through the first carrier feeding pipe 410, but is fed to the circulation tanks 100 through the second carrier feeding pipe 420. Meanwhile, the opening/closing valves 450 disposed on the circulation tank connecting portions of the second carrier feeding pipe 420 are operated in a manner that only the opening/closing valve of the circulation tank 100 in need of carrier supplementation is open while the others are closed. Accordingly, a consistent concentration of the developing solution is maintained.

Therefore, the printing is performed while the developing solution of a certain concentration within the circulation tanks 100 is fed to the developing unit 20. During the printing, the level sensors 146 and 166 disposed in the ink storage tanks 140 and the carrier storage tank 160 detect the liquid level of the condensed ink or the carrier stored in the respective tanks 140 and 160.

In this situation, if the detected results indicate 'low level or empty', the system controller generates a message for supplementation of the condensed ink or the carrier to the corresponding tanks. Here, the tank in need of the supplement may be an ink storage tank, or may be the carrier storage tank. If the condensed ink has to be supplemented to the ink storage tanks 140, then the color of the ink, i.e., yellow, magenta, cyan, and black, is indicated for selecting.

When the refill cartridge 200 is mounted on the common mounting section 222 of the developing solution refilling,/waste developing solution collecting means 220 in accordance with the message from the system controller, the valve unit 224 is moved to align the corresponding ink feeding valve 226*a* with the outlet 201 of the refill cartridge 200. Simultaneously, as the valve unit 224 is raised, the outlet 201 of the refill cartridge 200 and the corresponding ink feeding valve 226*a* of the valve unit 224 correspond to each other.

Next, the gear pump 330 connected to the corresponding ink storage tank 140 is driven in accordance with the signal from the system controller. Accordingly, the condensed ink stored in the refill cartridge 200 is pumped to the ink storage tank 140. In such a situation, since the back flow through the second ink feeding pipe 320 is prevented by the check valve 340', there is no possibility of the developing solution flowing back through the second ink feeding pipe 320 during the above condensed ink refilling process. As described above, the condensed ink or the carrier is supplemented to the ink storage tanks 140 or the carrier storage tank 160 which are in need of supplementation.

Meanwhile, when the amount of the waste developing solution stored in the waste tank 180 increases to the extent that it needs emptying, the waste developing solution evacuating process is performed either by mounting a new empty refill cartridge on the common mounting section 222, or by evacuating the waste developing solution of the waste tank 180 to the refill cartridge fixed on the common mounting section 222, which is emptied out during the above supplementing process. Hereinafter, the latter case will be described as follows:

First, the valve unit 224, which is raised with respect to the common mounting section 222, is lowered down to align the waste developing solution valve 226*c* of the valve unit 224 with the outlet 201 of the refill cartridge 200. Next, the valve unit 224 is raised and the outlet 201 of the refill cartridge 200 is connected to the waste developing solution valve 226*c*. Then the waste pump 190 disposed on the waste developing solution collecting pipe 186 operates to feed the waste developing solution stored in the waste tank 180 to the empty refill cartridge 200 by the pumping action.

As described above, according to the present invention, since the gear pump pumps the condensed ink or the carrier stored in the refill cartridge to the ink storage tanks or the carrier storage tank, there is no need to jointly store compressed air in the refill cartridge, and the condensed ink or the carrier is stored in the refill cartridge, purely. Accordingly, the property change of the condensed ink or the carrier, which is caused by compressed air is essentially prevented.

Further, since the condensed ink or the carrier stored in the ink storage tanks and the carrier storage tanks is fed to the circulation tanks by the gear pumps, the required amount of the condensed ink or the carrier is fed to the circulation tanks more precisely than the conventional structure which employs the constant feeding ink valve and the constant feeding carrier valve. Accordingly, the concentration of the developing solution is compensated more precisely and conveniently, and the printing quality is improved.

Further, according to the present invention, since the constant feeding ink valve and the constant feeding carrier valve, which are relatively expensive, can be omitted, there is an advantage that the manufacturing cost is reduced.

While the present invention has been particularly shown and described with reference to the preferred embodiment thereof, it will be understood by those skilled in the art that various changes in form and details may be effected therein without departing from the spirit and scope of the invention as defined by the appended claims.

What is claimed is:

1. A wet-type electrophotographic printer, comprising:

a developing unit, for developing an electrostatic latent image; and a first ink feeding/circulation unit, comprising:

an ink feeding valve, for admitting ink from a refill cartridge;

an ink storage tank, for storing ink from the refill cartridge;

a bidirectional gear pump mounted on said ink storage tank, for pumping ink into and out of the ink storage tank;

a first ink feeding pipe having a first check valve therein and extending from said ink feeding valve to said bidirectional gear pump, for feeding ink undirectionally from the ink feeding valve to the ink storage tank;

a circulation tank, for storing developing solution to be fed to the developing unit; and a second ink feeding pipe having a second check valve therein, extending from between said first check valve and said gear pump in said first ink feeding pipe to an input of said circulation tank, for feeding ink undirectionally from the ink storage tank to the circulation tank.

2. The wet-type electrophotographic printer of claim 1, further comprising:

a second ink feeding/circulation unit having the same structure as the first ink feeding/circulation unit, for feeding and storing ink and developing solution of a different color from that in the first ink feeding/circulation unit.

3. The wet-type electrophotographic printer of claim 2, further comprising:

a total of four ink feeding/circulation units, for use with four different color inks.

4. The wet-type electrophotographic printer of claim 1, further comprising:

an unpressurized refill cartridge for supplying ink for refilling the ink storage tank.

5. The wet-type electrophotographic printer of claim 1, further comprising:

a carrier feeding unit, comprising:

a carrier feeding valve, for admitting carrier from a refill cartridge;

a carrier storage tank, for storing carrier;

a bidirectional second gear pump mounted on said carrier storage tank, for pumping carrier into and out of the carrier storage tank;

a first carrier feeding pipe having a third check valve therein and extending from said carrier feeding valve to said second bidirectional gear pump, for feeding carrier unidirectionally from the carrier feeding valve to the carrier storage tank; and a second carrier feeding pipe having a fourth check valve therein and extending from between said third check valve and said second gear pump in said first carrier feeding pipe to a valve leading to said circulation tank, for feeding carrier to said circulation tank.

6. The wet-type electrophotographic printer of claim 3, further comprising:

a carrier feeding unit, comprising:

a carrier feeding valve, for admitting carrier from a refill cartridge;

a carrier storage tank, for storing carrier;

a bidirectional second gear pump mounted on said carrier storage tank, for pumping carrier into and out of the carrier storage tank;

a first carrier feeding pipe having a third check valve therein and extending from said carrier feeding valve to said second bidirectional gear pump, for feeding carrier unidirectionally from the carrier feeding valve to the carrier storage tank; and a second carrier feeding pipe having a fourth check valve therein and extending from between said third check valve and said second gear pump in said first carrier feeding pipe to valves leading to each of the circulation tanks of the four ink feeding/circulation units, for feeding carrier to the circulation tanks.

7. The wet-type electrophotographic printer of claim 6, further comprising:

an unpressurized refill cartridge for supplying ink for refilling the ink storage tanks.

8. A developing solution feeding apparatus of a wet type electrophotographic color printer, comprising:

a plurality of circulation tanks for storing developing solutions to be fed to a developing unit of the printer;

a plurality of injection nozzles for jetting the developing solutions stored in the respective circulation tanks to a developing gap of the developing unit;

a plurality of ink storage tanks for storing condensed ink of different colors to be fed to the respective circulation tanks;

a carrier storage tank for storing a carrier to be fed to the respective circulation tanks;

a waste tank for collecting waste developing solution produced from the respective circulation tanks;

a refill cartridge for storing condensed ink of a certain color or the carrier to supplement the condensed ink or the carrier of the ink storage tanks or the carrier storage tank;

developing solution refilling/waste developing solution collecting means for refilling the condensed ink or the carrier of the refill cartridge to the ink storage tanks or the carrier storage tank, and for collecting the waste developing solution in the waste tank to the empty refill cartridge; and ink injecting/constant feeding means for jetting the condensed ink of the refill cartridge to the ink storage tanks during the condensed ink refilling process by the developing solution refilling/waste developing solution collecting means, and for feeding the required amount of the condensed ink stored in the ink storage tanks to the circulation tanks.

9. The apparatus as claimed in claim 8, further comprising:

an ink agitator in each of the ink storage tanks; and a single driving source for driving the ink agitators.

10. The apparatus as claimed in claim 8, said developing solution refilling/waste developing solution collecting means comprising:

a common mounting section for mounting the refill cartridge thereon; and a valve unit disposed under the common mounting section to be moved in both vertical and horizontal directions, and having a plurality of valves to be fitted to the outlet of the refill cartridge, the valves being comprised of a plurality of ink feeding valves connected to the respective ink storage tanks; a carrier feeding valve connected to the carrier storage tank; and a waste developing solution valve connected to the waste tank, to refill the corresponding tank with the condensed ink or the carrier and to collect the waste developing solution of the waste tank in the empty refill cartridge.

11. The apparatus as claimed in claim 10, said ink injecting/constant feeding means comprising:

a first ink feeding pipe for connecting a plurality of ink feeding valves formed on the valve unit with the respective ink storage tanks;

a second ink feeding pipe branched from the first ink feeding pipe, and connected to the circulation tanks, respectively;

a gear pump disposed on the first ink feeding pipe, for jetting the condensed ink of the refill cartridge to the ink storage tanks by the pumping action while being driven in a certain direction, and for feeding the condensed ink of the ink storage tanks to the circulation tanks with the pumping action while being driven in a reverse direction; and back flow preventing means disposed on the first and second ink feeding pipes, for selectively opening/closing the first and second ink feeding pipes, to thereby prevent a back flow of the ink while the ink is pumped by the gear pump.

12. The apparatus as claimed in claim 11, wherein the back flow preventing means is a check valve.

13. The apparatus as claimed in claim 8, further comprising:

a carrier injecting/constant feeding means for jetting the carrier of the refill cartridge to the carrier storage tank during the carrier refilling process by the developing solution refilling/waste developing solution collecting means, and for feeding the required amount of the carrier stored in the carrier storage tank to the circulation tanks.

14. The apparatus as claimed in claim 13, said developing solution refilling/waste developing solution collecting means comprising:

a common mounting section for mounting the refill cartridge thereon; and a valve unit disposed under the common mounting section to be moved in vertical and horizontal directions, and having a plurality of valves to be fitted to the outlet of the refill cartridge, the valves being comprised of a plurality of ink feeding valves connected to the respective ink storage tanks, a carrier feeding valve connected to the carrier storage tank, and a waste developing solution valve connected to the waste tank, to refill the corresponding tank with the condensed ink or the carrier and to collect the waste developing solution of the waste tank in the empty refill cartridge.

15. The apparatus as claimed in claim 14, said carrier injecting/constant feeding means comprising:

a first carrier feeding pipe for connecting the carrier feeding valve of the valve unit with the carrier storage tank;

a second carrier feeding pipe branched from the first carrier feeding pipe and connected to the respective circulation tanks;

a gear pump disposed on the first carrier feeding pipe, for jetting the carrier of the refill cartridge to the carrier storage tank by the pumping action while being driven in a certain direction, and for jetting the carrier of the carrier storage tank to the circulation tanks by the pumping action while being driven in a reverse direction;

back flow preventing means disposed on the first and second carrier feeding pipes, for selectively opening/closing the first and second carrier feeding pipes, to thereby prevent a back flow of the carrier while the carrier is pumped by the gear pump; and a plurality of opening/closing valves disposed on the circulation tank connecting portions of the second carrier feeding pipe, for selectively opening/closing the circulation tank connecting portions.

16. The apparatus as claimed in claim 15, said back flow preventing means being a check valve.

17. A wet type electrophotographic color printer having a photosensitive medium; a charged unit for electrifying the surface of the photosensitive medium to a certain electric potential; an exposure unit for forming an electrostatic latent image on the photosensitive medium by jetting a beam converted in accordance with an electrical data of the to-be-printed portions to the photosensitive medium; a developing unit for developing the latent image of the photosensitive medium by feeding developing solution to the photosensitive medium; a transferring unit for transferring the image of the photosensitive medium to a printing paper; and a developing solution feeder for appropriately feeding the developing solution of a certain concentration to the developing unit, wherein the developing solution feeder comprises:

a plurality of circulation tanks for storing the developing solution to be fed to the developing unit, and having a concentration detecting device for detecting the concentration of the developing solution stored therein;

a plurality of injection nozzles for jetting the developing solution stored in the respective circulation tanks to a developing gap of the developing unit;

a plurality of ink storage tanks for storing condensed ink of a certain color to be fed to the respective circulation tanks, and having ink agitators disposed therein to be driven by a single driving, source;

a carrier storage tank for storing carrier to be fed to the respective circulation tanks;

a waste tank for collecting waste developing solution produced from the respective circulation tanks;

a refill cartridge for storing the condensed ink of a certain color or the carrier for supplementation of the condensed ink or the carrier to the ink storage tanks or the carrier storage tank;

developing solution refilling/waste developing solution collecting means having a common mounting section for mounting the refill cartridge thereon, and a valve unit which is disposed under the common mounting section to be moved in vertical and horizontal directions, which is provided with a plurality of valves to be fitted to the outlet of the refill cartridge, for refilling the ink storage tanks or the carrier storage tank with the condensed ink or the carrier of the refill cartridge, and also for collecting the waste developing solution collected in the waste tank to the empty refill cartridge;

ink injecting/constant feeding means for jetting the condensed ink of the refill cartridge to the ink storage tanks during the condensed ink refilling process by the developing solution refilling/waste developing solution collecting means, and also for feeding the required amount of the condensed ink stored in the ink storage tanks to the circulation tanks; and carrier injecting/constant feeding means for jetting the carrier of the refill cartridge to the carrier storage tank during the carrier refilling process by the developing solution refilling/waste developing solution collecting means, and for feeding the required amount of the carrier stored in the carrier storage tank to the circulation tanks.

18. The apparatus as claimed in claim 17, said ink injecting/constant feeding means comprising:

a first ink feeding pipe for connecting a plurality of ink feeding valves formed on the valve unit with the respective ink storage tanks;

a second ink feeding pipe branched from the first ink feeding pipe, and connected to the circulation tanks, respectively;

a gear pump disposed on the first ink feeding pipe, for jetting the condensed ink of the refill cartridge to the ink storage tanks by the pumping action while being driven in a certain direction, and for feeding the condensed ink of the ink storage tanks to the circulation tanks by the pumping action while being driven in a reverse direction; and backflow preventing means disposed on the first and second ink feeding pipes for selectively opening/closing the first and second ink feeding pipes, to thereby prevent a back flow of the ink while the ink is being pumped by the gear pump.

19. The apparatus of claim 18, said carrier injecting/constant feeding means comprising:

a first carrier feeding pipe for connecting the carrier feeding valve of the valve unit with the carrier storage tank;

a second carrier feeding pipe branched from the first carrier feeding pipe and connected to the respective circulation tanks;

a gear pump disposed on the first carrier feeding pipe, for jetting the carrier of the refill cartridge to the carrier storage tank by the pumping action while being driven in a certain direction, and for feeding the carrier of the carrier storage tank to the circulation tanks by the pumping action while being driven in a reverse direction;

back flow preventing means disposed on the first and second carrier feeding pipes for selectively opening or closing the first and second carrier feeding pipes, to thereby prevent a back flow of the carrier while the carrier is being pumped by the gear pump; and a plurality of opening/closing valves disposed on the circulation tank connecting portions of the second carrier feeding pipe, for selectively opening or closing the circulation tank connecting portions.

* * * * *